United States Patent [19]

Oda et al.

[11] Patent Number: 4,744,348

[45] Date of Patent: May 17, 1988

[54] DRESSING APPARATUS FOR GRINDING WHEELS

[75] Inventors: Hideaki Oda; Akira Unozawa, both of Higashimatsuyama, Japan

[73] Assignee: Diesel Kiki Co., Ltd., Tokyo, Japan

[21] Appl. No.: 929,688

[22] Filed: Nov. 12, 1986

[51] Int. Cl.[4] ..... B24B 53/14

[52] U.S. Cl. ..... 125/11 CD; 51/165.92; 51/165.77

[58] Field of Search ..... 51/165.87, 165.88, 165.92, 51/165.77; 125/11 CP

[56] References Cited

U.S. PATENT DOCUMENTS 3,552,375 1/1971 Carr ..... 125/11 CD
3,683,885 8/1972 Kikuchi ..... 125/11 CD
4,266,374 5/1981 Asauo ..... 125/11 CD
4,637,169 1/1987 Sigg ..... 51/165.92

*Primary Examiner*—Harold D. Whitehead
*Attorney, Agent, or Firm*—John E. Toupal; Harold G. Jarcho

[57] ABSTRACT

A grinding wheel dressing apparatus including a housing, a dresser shaft rotatably mounted on the housing and having one end adapted for connection to a drive shaft and an opposite end adapted to receive a dresser wheel, and an acoustic sensor retained by the housing and adapted to detect acoustic signals produced by contact between the rotating dresser wheel and a grinding wheel being dressed thereby.

6 Claims, 2 Drawing Sheets

DRESSING APPARATUS FOR GRINDING WHEELS

BACKGROUND OF THE INVENTION

The present invention relates generally to a rotary apparatus for shaping and dressing grinding wheels and, more specifically, to such apparatus with acoustic position sensing.

As shown in FIG. 5, a conventional grinding-wheel dressing apparatus includes a dresser shaft 130 supported on a housing 119 by bearings 115, 116 and 91. A cup-shaped dresser wheel 3 having a cutting edge 2 formed of diamond or the like is mounted at the left end of the dresser shaft 130 and abuts against a flange 123. Securing the dresser wheel 3 is a nut 28 engaging a threaded shaft 26. A portion of the dresser shaft 130 protruding from a left end wall of the housing 119 is sealed by a seal member 114. Interposed between the bearings 116 and 91 are an outer sleeve 117 and an inner sleeve 116. A nut 125 is threadedly engaged with a right end of the dresser shaft 130 and exerts on the inner race of the bearing 91 a force that renders the dresser shaft 130 immovable in an axial direction. The outer race of the bearing 91 is fitted into the right end of the housing 119 and is retained by a cover plate 112 secured by a bolt. Integrally formed with the hollow cover plate 112 is a screw shaft 112*a*. A conduit (not shown) is connected to the screw shaft 112*a*, and an end of a drive shaft (not shown) is connected within an opening 127 to the dresser shaft 130.

The rotary dresser device shown in FIG. 5 is used to shape a grinding wheel and thereby provide a high precision grinding surface. To enhance the efficiency of the shaping process, it is important to minimize contact (grinding allowance) between the dresser and the grinding wheel while obtaining the desired cutting surface. That objective is provided, typically, by an operator who relies on his hearing to detect the noise produced when the dresser wheel contacts the grinding wheel. Such human detection is low in accuracy and generally is accompanied by substantial error. Consequently, the efficiency of the shaping operation is deteriorated resulting in increased grinding costs.

The object of the present invention, therefore, is to provide a grinding wheel dressing apparatus which can produce highly accurate dressing and minimum loss of the abrasive grains used in expensive grinding wheels.

SUMMARY OF THE INVENTION

The invention is a grinding wheel dressing apparatus including a housing, a dresser shaft rotatably mounted on the housing and having one end adapted for connection to a drive shaft and an opposite end adapted to receive a dresser wheel, and an acoustic sensor retained by the housing and adapted to detect acoustic signals produced by contact between the rotating dresser wheel and a grinding wheel being dressed thereby. The acoustic sensor provides highly sensitive detection of contact between the dresser and grinding wheels.

According to certain features of the invention, the housing defines a fluid chamber for accommodating pressurized fluid functional to couple the acoustic signals between the acoustic sensor and the contacting surfaces of the dresser and grinding wheels and the apparatus includes a supply means for supplying pressurized fluid to the fluid chamber. The fluid chamber improves the signal coupling between the acoustic sensor and the contacting wheels.

In one embodiment, the invention includes a nozzle retained by the housing means in a position preferably spaced from the dresser wheel by a distance of between 0.3 and 0.5 millimeters and arranged to discharge pressurized fluid onto the dresser wheel. The fluid discharge provided by the nozzle further improves signal coupling between the acoustic sensor and the contacting wheels.

According to specific features of the aforesaid embodiment, the fluid chamber is defined by a first bore in the housing and oriented substantially parallel to the dresser shaft, and the acoustic sensor is retained in a second bore in the housing and oriented substantially parallel to the dresser shaft. This arrangement provides the components in a desirable compact package.

In another embodiment of the invention, the fluid chamber comprises an annular chamber disposed between the housing and the dresser shaft and preferably located directly adjacent to the opposite end of the dresser shaft. This arrangement provides a device with structural simplicity.

DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENT

Figure 1:
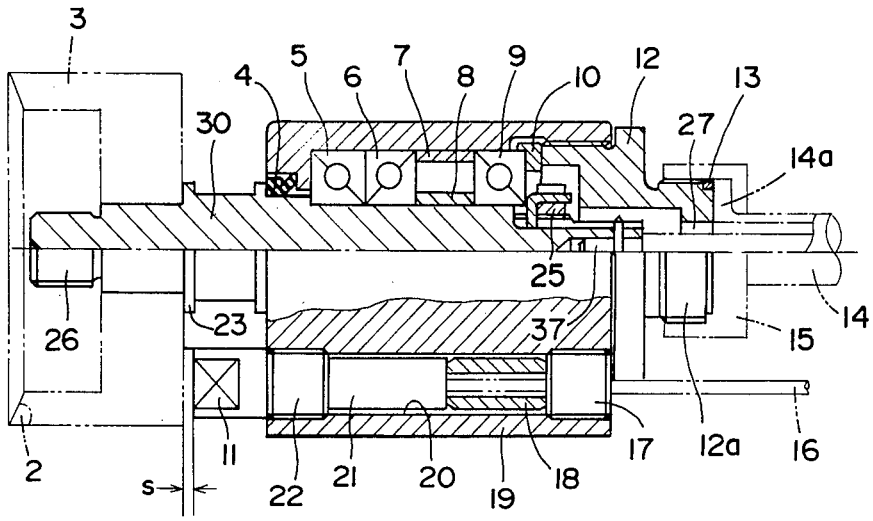
FIG. 1 is a schematic side sectional view of a grinding wheel dressing apparatus in accordance with a first embodiment of the present invention.
Figure 2:
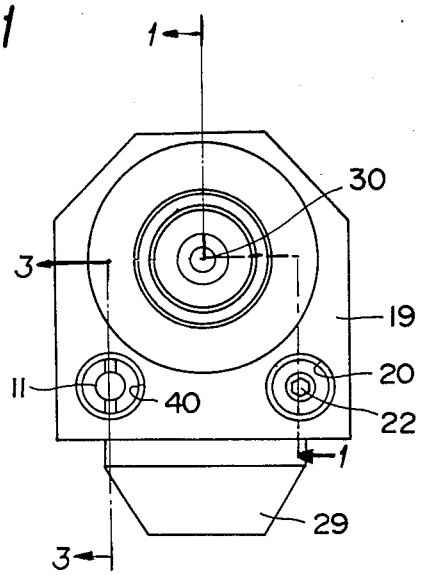
FIG. 2 is a front view of the embodiment shown in FIG. 1.
Figure 3:
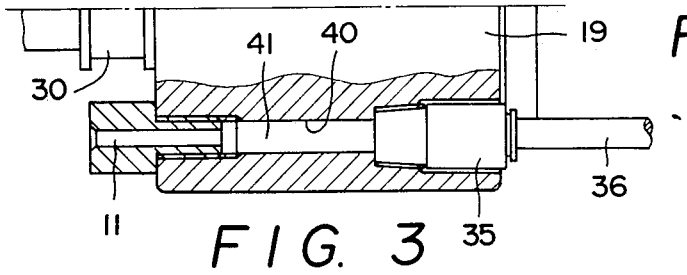
FIG. 3 is a schematic side sectional view taken on lines 3—3 of FIG. 2.

As shown in FIGS. 1-3, a dresser wheel 30 is supported on a housing 19 by bearings 5, 6 and 9. A left end portion of the dresser shaft 30 protruding from the housing 19 is sealed by a seal member 4. Interposed between the bearings 6 and 9 are an inner sleeve 8 and an outer sleeve 7. An inner race of the bearing 9 is retained by a nut 25 threadedly engaged with the dresser shaft 30, and a ring 10 is urged against an outer race of the bearing 9 by a cover plate 12 threadedly engaging the housing 19. Accordingly, the dresser shaft 30 is prevented from moving axially relative to the housing 19.

The hollow cover plate 12 is formed integrally with a screw shaft 12*a* which abuts an end flange 14*a* of a pipe 14 through a seal member 13. Retaining the flange 14*a* is a cap nut 15 in threaded engagement with the screw shaft 12*a*. An end of a drive shaft 37 inserted into the pipe 14 is fitted into an opening provided at the right end of the dresser shaft 30. Fitted onto a left end of the dresser shaft 30 and in abutment against a flange 23 is a dresser wheel 3 having a cutting edge 2. The dresser wheel 3 is fastened by a nut (not shown) engaging a threaded portion 26 of the dresser shaft 30.

As shown in FIG. 2, the housing 19 is provided on the undersurface thereof with a conically shaped mounting pedestal 29 insertable into a conical opening (not shown) formed in a predetermined portion of the dressing apparatus, and secured therein in a well known manner. This latter structure has no direct relationship with the subject matter of the present invention and therefore will not be further described.

According to the present invention, the housing 19 is provided with first and second bores 20 and 40, respectively, parallel with and straddling the dresser shaft 30. An acoustic emission (AE) sensor 21, which will be further described later, is retained in the first bore 20. Threadedly engaged in one end of the second bore 40 is a cutting liquid injection nozzle 11. A conduit 36 for supplying cutting liquids is connected by a nipple 35 to an opposite end of the second bore 40 which defines a fluid chamber as shown in FIG. 3.

The AE sensor 21 is retained in the first bore 20 formed in the housing 19 as shown in FIG. 1. Closing the left end of the first bore 20 is a plug 22. Similarly, the right end of the first bore 20 is closed by inserting a threaded plug 17 against a spacer 18 through which a conductor 16 passes.

OPERATION

Prior to use of the dressing apparatus shown in FIGS. 1–3, a dresser wheel 3 is fixed onto the shaft 30 in a position spaced from the nozzle 11 by a distance preferably between 0.3 to 0.5 mm. The nozzle 11 and the threaded plug 22 are firmly fixed into ends, respectively, of the second bore 40 and the first bore 20 by suitable adhesives. In addition, the inner end surface of the threaded plug 22 is coated with grease and against which the left end detection surface of the AE sensor 21 is urged.

In the case of a disc-type grinding wheel (not shown), a rotational shaft thereof is arranged at approximately 30° with respect to the dresser shaft 30, and the grinding wheel is fed in an axially transverse direction while being rotated. Such movement produces contact between the cutting edge 2 of the dresser wheel 3 and a peripheral surface of the grinding wheel. The supersonic oscillations produced in the dresser wheel 3 by the shock occuring instantaneously with the contact of the cutting edge 2 and the grinding wheel are transmitted to the fluid chamber 40 via the cutting liquid injected by the nozzle against the dresser wheel 3. Thereafter, the supersonic oscillations are further transmitted to the AE sensor 21 through the housing 19 and the threaded plug 22. A detection signal from the AE sensor 21 is fed by signal wires 16 to an electric controller (not shown) that effects output functions in response to the received indication of contact between the grinding and dresser wheels.

Thus, during a slow feed of the grinding wheel in a direction transverse to the dresser shaft 30, the initial contact with the cutting edge is detected by the AE sensor 21. Accordingly, when thereafter, a feed parallel with the dresser shaft 30 is applied to the grinding wheel, shaping or dressing of a grinding wheel is carried out with a minimum grinding allowance produced by the cutting edge 2.

Figure 4:
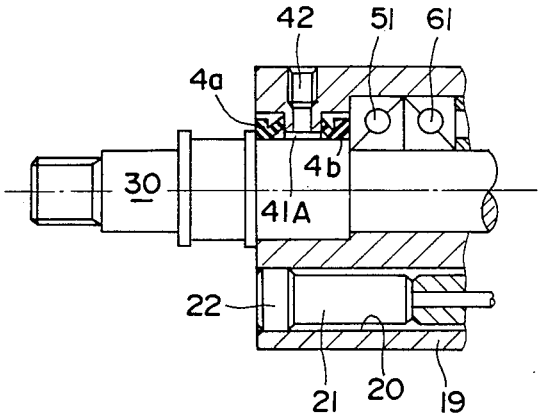
FIG. 4 is a schematic side sectional view showing essential parts of another grinding wheel dressing apparatus in accordance with the present invention.
Figure 5:
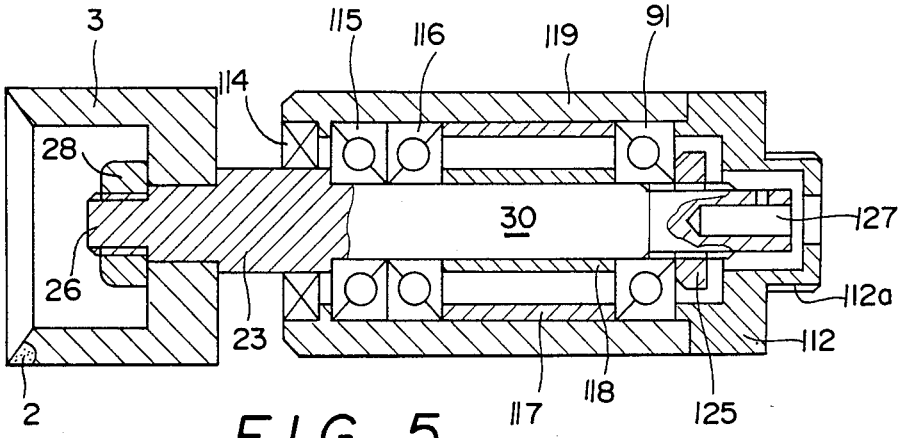
FIG. 5 (PRIOR ART)
FIG. 5 is a side sectional view of a conventional dressing apparatus for grinding wheels.

In an exbodiment shown in FIG. 4, an annular fluid chamber 41A is provided between the housing 19 and the dresser shaft 30 in a location directly adjacent to the dresser wheel 3. Side walls of the liquid chamber 41A are formed by an annular seal member **4*b* adjacent to a bearing 51 and an annular seal member 4*a* adjacent to an end wall of the housing 19. Pressurized liquid is injected into the fluid chamber 41 through a tapped source hole 42. The tapped hole 42 can be either sealed by a threaded Plug (not shown) or used to continuously supply pressurized liquid to the fluid chamber 41A. In addition, an accumulator (not shown) may be connected to the tapped hole 42. Supersonic oscillatoons produced by contact between the grinding and dresser wheels are transmitted through the dresser shaft 30, the fluid chamber 41A, the housing 19 and the plug 22 to the AE sensor 21**.

In accordance with the present invention, therefore, supersonic oscillations produced at the instant the cutting edge 2 comes into contact with a grinding wheel are transmitted directly from the dresser 3 to the cutting liquid in either of the fluid chambers 40 or 41A and then transmitted to the AE sensor 21 through the housing 19 and the threaded plug 22, In that way, the attenuation of the supersonic oscillations is minimized and excellent transmission efficiency achieved. Since movements in the micron range can be detected by the AE sensor 21, the peripheral surface of the grinding wheel can be shaped or dressed with a minimum feed of a grinding wheel, i.e., a minimum grinding allowance. Accordingly, waste of grinding material can be reduced and the useful life of grinding wheels improved.

Obviously, many modifications and variations of the present invention are possible in light of the above teachings. It is to be understood, therefore, that the invention can be practiced otherwise than as specifically described.

What is claimed:

1. A grinding wheel dressing apparatus comprising:

a dresser shaft rotatably mounted and having one end adapted for connection to a drive shaft and an opposite end adapted to receive a dresser wheel;

an acoustic sensor adapted to detect acoustic signals produced by contact between the rotating dresser wheel and a grinding wheel being dressed thereby;

a housing means retaining said dresser shaft and said acoustic sensor and defining a fluid chamber adapted to couple said acoustic signals between said acoustic sensor and the contacting surfaces of the dresser and grinding wheels; and supply means for supplying pressurized fluid to said fluid chamber.

2. An apparatus according to claim 1 including nozzle means communicating with said fluid chamber and arranged to discharge pressurized fluid therefrom onto the dresser wheel.

3. An apparatus according to claim 2 wherein said nozzle means is retained by said housing means in a position spaced from the dresser wheel by a distance of between 0.3 and 0.5 millimeters.

4. An apparatus according to claim 3, wherein said fluid chamber is defined by a first bore in said housing means and oriented substantially parallel to said dresser shaft, and said acoustic sensor is retained in a second bore in said housing and oriented substantially parallel to said dresser shaft.

5. An apparatus according to claim 1 wherein said fluid chamber comprises an annular chamber disposed between said housing means and said dresser shaft.

6. An apparatus according to claim 5 wherein said annular chamber is located directly adjacent to said opposite end of said dresser shaft.

* * * * *